United States Patent [19]

Gatsis

[11] 4,338,183

[45] Jul. 6, 1982

[54] METHOD OF SOLVENT EXTRACTION OF COAL BY A HEAVY OIL

[75] Inventor: John G. Gatsis, Des Plaines, Ill.

[73] Assignee: UOP Inc., Des Plaines, Ill.

[21] Appl. No.: 196,428

[22] Filed: Oct. 14, 1980

[51] Int. Cl.[3] ..... C10G 1/06

[52] U.S. Cl. ..... 208/10

[58] Field of Search ..... 208/10

[56] References Cited

U.S. PATENT DOCUMENTS

| | | | |
|---|---|---|---|
| 3,607,718 | 9/1971 | Leaders et al. | 208/10 |
| 3,705,092 | 12/1972 | Gatsis | 208/8 |
| 3,840,456 | 10/1974 | Yavorsky et al. | 208/10 |
| 3,852,183 | 12/1974 | Snell | 208/10 |
| 4,011,153 | 3/1977 | Fu | 208/10 |
| 4,077,867 | 3/1978 | Aldridge et al. | 208/10 |

FOREIGN PATENT DOCUMENTS

| | | | |
|---|---|---|---|
| 2444827 | 4/1976 | Fed. Rep. of Germany | 208/10 |
| 257484 | 4/1970 | U.S.S.R. | 208/10 |

*Primary Examiner*—Delbert E. Gantz
*Assistant Examiner*—William G. Wright
*Attorney, Agent, or Firm*—James R. Hoatson, Jr.; John G. Cutts, Jr.; William H. Page, II

[57] ABSTRACT

A solid carbonaceous material, such as coal, is converted to liquid products and the asphaltene content of a heavy hydrocarbonaceous liquid is reduced in the process wherein the solid is solvent extracted by the heavy hydrocarbonaceous liquid and a hydrocarbonaceous recycle stream with a finely divided, unsupported metal catalyst and the resultant mixture of liquids is recovered as the product.

7 Claims, No Drawings

METHOD OF SOLVENT EXTRACTION OF COAL BY A HEAVY OIL

BACKGROUND OF THE INVENTION

This invention relates to a process for the conversion of carbonaceous materials, such as coal, to liquid products. More particularly, this invention relates to a process for the conversion of coal to a liquid product by solvent extraction of the coal using a heavy hydrocarbonaceous liquid containing heptane-insoluble material and a hydrocarbonaceous recycle stream, and recovery of the mixture of the solvent and liquified coal as the product of the process.

Resources of solid carbonaceous substances such as coal, lignite, oil shale, etc. represent a valuable source of raw materials for the production of liquid hydrocarbon products commonly obtained from petroleum. The relative abundance of sources of solid carbonaceous materials with respect to those of petroleum, makes the use of these solids to supplement and replace petroleum as energy sources economically desirable.

Several processes for converting coal to valuable liquid products are known to the art. Recently, high pressure hydrogenation and solvent extraction techniques have been developed, the latter of which is related to the process of this invention. In the processes of solvent extraction known to the prior art, crushed, finely-divided particulate coal, or other carbonaceous material, is placed in contact with a liquid solvent which dissolves a part of the solid, usually in the presence of hydrogen gas. Following the contact, the liquid solvent and the liquified part of the solid are separated from the remaining solid material by filtration, centrifuging or a similar operation. In the other processes known to the prior art, the previously solid material is separated from the solvent, typically by fractional distillation, and is further processed by conventional hydrocarbon processing techniques such as coking, cracking, hydrogenation, etc., to convert the solvent extracted material into more useful products.

A pertinent prior art reference is U.S. Pat. No. 3,705,092 which teaches a process for the extraction of coal with heavy hydrocarbonaceous liquids while simultaneously improving the quality of the hydrocarbonaceous liquids. The present invention recognizes the fact that the prior art process is improved by recycling at least a portion of the reaction zone effluent.

Another example of the typical prior art in the area of coal hydroconversion is U.S. Pat. No. 4,077,867.

One of the problems encountered in the solvent extraction method of liquefying solid carbonaceous substances is the non-selective nature of the solvation which takes place. The process is intended to extract the most valuable, hydrogen-rich fraction of the solid. But solvents which are effective in extracting this hydrogen-rich fraction also liquify an undesirable fraction containing asphaltenes. Asphaltenes are undistillable compounds of carbon of high molecular weight, and contain less than about 7% hydrogen by weight. Asphaltenes are also insoluble in normal heptane. They are present not only in the products from solvent extraction of carbonaceous materials such as coal, but also in petroleum crude oil and fractions thereof such as topped or reduced crude oils, heavy cycle stocks visbreaker liquid effluent and the bottoms from atmospheric crude towers. The asphaltenic fractions of all these liquid hydrocarbons are of little intrinsic value and interfere with the processing of the more valuable heavy oil fractions with which they are mixed. Thus, the reduction of the asphaltene content in any processable hydrocarbon liquid is a desirable improvement thereof. Further conversion of asphaltenes to distillable hydrocarbons is possible by recycling at least a portion of the reaction zone effluent.

OBJECTS AND EMBODIMENTS

The objective of this invention is to originate an efficient method for the conversion of solid carbonaceous materials to valuable liquid products and the simultaneous improvement of the properties of a heavy hydrocarbon liquid. More specifically, the object of this invention is an efficient method for the solvent extraction of valuable liquids from solid carbonaceous materials and the simultaneous conversion of a part of a heavy hydrocarbon liquid from a less desirable material to a more desirable material. The particular object of this invention is the efficient solvent extraction of a valuable fraction of a solid carbonaceous material with a concurrent reduction in the asphaltenes contained in a heavy hydrocarbon liquid.

As hereinabove set forth, these objects are accomplished through the utilization of a heavy asphaltene-containing hydrocarbonaceous liquid as the solvent in a process for the solvent extracting of solid carbonaceous materials. Therefore in one embodiment the present invention provides a process for producing hydrogen-enriched hydrocarbonaceous products from coal and an asphaltene containing petroleum oil which comprises contacting said coal and asphaltene containing petroleum oil in the presence of hydrogen, and a hereinafter described liquid recycle stream containing finely divided, unsupported metal catalyst said metal being selected from the group consisting of Groups IVB, VB, VIB, VIIB and VIII of the Periodic Table of Elements and mixtures thereof in a reaction zone at a temperature from about 55° F. to about 935° F. and a hydrogen pressure from about 500 psig to about 10,000 psig to liquefy at least a portion of said coal and to reduce the asphaltene content of said oil; and solvent deashing at least a portion of the reaction zone effluent to provide said liquid recycle stream utilized in step (a) which recycle stream contains finely divided, unsupported metal catalyst.

In the preferred embodiment of my invention, comminuted coal is introduced into a solvent extraction zone where it is admixed with a petroleum crude oil and a liquid recycle stream in the presence of hydrogen gas and a finely divided, unsupported metal catalyst at a temperature and pressure which will produce a liquefaction of a portion of the coal.

The crude oil, used as the solvent in the preferred embodiment, contains sufficient heavy oils such that at least 80% of the crude boils above about 650° F. and 50% boils above about 1000° F.

In a general embodiment of the present invention, the admixed heavy hydrocarbonaceous liquid solvent, the coal, the liquid recycle stream and the finely divided, unsupported metal catalyst are subjected to sufficient temperature and pressure, in the presence of hydrogen gas, to liquefy the desired fraction of the solid. The solvent extraction and hydrocarbon conversion process may be conducted in either a batch or a continuous reaction vessel. Solvent extraction and hydrocarbon conversion conditions include a temperature of about 55° F. to about 950° F. and a pressure of about 500 psig to about 10,000 psig. Hydrogen gas is present at the above-indicated pressure.

DETAILED DESCRIPTION OF THE INVENTION

The process of the present invention is generally applicable to hydroconvert coal and a heavy hydrocarbonaceous liquid into more valuable hydrocarbonaceous products. The term coal is used herein to designate a normally solid carbonaceous material including all ranks of coal, such as lignite, anthracite coal, bituminous coal, semi-bituminous coal and mixtures thereof.

The heavy hydrocarbonaceous liquid solvent utilized in the solvent extraction may be any heavy hydrocarbon substance which is liquid at the solvent extraction conditions, contains asphaltenes that are insoluble in normal heptane, and 80% of which boils above about 650° F. and 50% of which boils above about 1000° F. The liquid hydrocarbonaceous solvent and coal may be admixed in any weight ratio but a weight ratio from about 1 part solvent to 1 part coal up to about 5 parts solvent to 1 part coal is preferred.

In the preferred embodiment of the present invention, the coal is a bituminous coal having a high content of volatile material. Typically, a high content of volatile material would be about 20% or higher volatiles in the moisture and ash free coal. The coal is subjected to extraction and conversion conditions in a finely-divided state. Said finely-divided state is well exemplified by coal particles which pass through about a 200 mesh or finer Tyler sieve.

The liquid hydrocarbonaceous solvent utilized in the preferred embodiment of the present invention is a heavy whole crude oil. Typical of the preferred solvent is a Cold Lake crude oil having an API gravity of about 10 and containing a fraction of materials insoluble in normal heptane of about 8%. The crude oil, used as the solvent in the preferred embodiment, contains sufficient heavy oils such that at least 80% of the crude boils above 650° F. and 50% boils above 1000° F.

In a general embodiment of the present invention, the admixed solvent, the coal and the liquid recycle stream are subjected to sufficient temperature and pressure, in the presence of hydrogen gas, to liquefy the desired fraction of the coal. The solvent extraction process may be conducted in either a batch or a continuous reaction vessel. Solvent extraction conditions include a temperature of about 55° F. to about 950° F. and a pressure of about 500 psig to about 10,000 psig. Hydrogen gas is present at the above-indicated pressure.

Preferably, the admixed solvent, the coal and the liquid recycle stream are processed in a continuous reaction vessel at a flow rate which results in a liquid hourly space velocity of about 0.5 to about 10, where the liquid hourly space velocity is defined as the volumetric flow of the feed per hour divided by the volume of the reactor. The hydrogen gas is recycled to the process from the reactor effluent at a rate of about 5,000 to about 20,000 SCFB of combined solvent, coal and liquid recycle stream, and hydrogen gas is added to the reaction at a rate sufficient to maintain the above stated range of pressures.

After the reactants have been exposed to the solvent extraction conditions for a length of time sufficient for the desired fraction of the solid to have been liquified, the reaction zone contents are withdrawn. The gas is separated from the reaction zone effluent. The slurry is solvent deashed under selected process conditions to effect a separation yielding a high grade synthetic crude and a heavy liquid phase. The heavy liquid phase contains high boiling, high molecular weight material, unconverted coal, catalyst and essentially all the mineral matter. A portion of the heavy liquid phase is recycled to the inlet of the reaction zone.

In the preferred embodiment of the present invention, the above-described, finely divided, solid bituminous coal is admixed with the above described heavy petroleum crude oil solvent at a weight ratio of two parts crude oil to one part solid coal. A portion of the subsequently derived liquid stream is recycled to the inlet of the extraction zone at a weight ratio of one part extraction zone effluent to one part solid coal. This mixture of coal, crude oil and liquid recycle stream forms the feed to the reaction or extraction zone, wherein the solvent extraction of this preferred embodiment is maintained. The solvent extraction conditions of the preferred embodiment include a temperature of about 850° F. and a hydrogen gas pressure of about 3000 psig. The feed to the reaction zone is continuously passed through the reaction zone at a rate sufficient to maintain a liquid hourly space velocity of about 0.5 based on the volume of the fresh feed. Hydrogen gas is recycled to the reaction zone from the reaction zone effluent at a rate of about 15,000 SCFB of the feed to the reaction zone. The solvent extraction conditions should be maintained so as to produce a conversion of the solid coal to a liquid extract of about 70% by weight of the moisture-and-ash-free coal.

When the feed to the reaction zone has been subjected to said solvent extraction conditions, it is collected as the effluent from the reaction zone. During the period that the feed was subjected to the solvent extraction conditions, about 70% of the solid coal will have been liquefied to form valuable hydrocarbon products and a part of the crude oil solvent, which was insoluble in normal heptane, will have been converted into a material which is soluble in normal heptane.

The reaction zone effluent after removal of the normally gaseous components is separated by solvent separation to effect separation of the solids from the liquid product. A portion of the solid containing liquid stream is recycled to join the fresh feed to the reaction zone inlet.

The hydrocarbons recovered from the process of the present invention constitute a synthetic crude oil which can be processed in the same manner as any common petroleum crude oil. Both the component derived from the solid and the component derived from the solvent are improved from the process of this invention in that the content of asphaltenes is reduced in both. This reduction in asphaltenes in the synthetic crude oil, particularly with respect to the component derived from the solid, renders the resulting hydrocarbon more readily processable than is the hydrocarbon obtained in the solvent extraction processes known to the prior art.

A suitable liquid recycle stream may be prepared from the whole or a fraction of the extraction zone effluent. A preferred liquid recycle stream is prepared by first removing the normally gaseous components from the extraction zone effluent and then removing the desirable hydrocarbonaceous product with a relatively low molecular weight hydrocarbon solvent in a solvent separation procedure while leaving a component which is well suited for the desired liquid recycle stream and which contains essentially all of the ash, unconverted coal, asphaltenes, relatively high molecular weight hydrocarbons and a finely divided, unsupported metal catalyst.

The solvent separation procedure hereinbefore mentioned is similar to solvent deasphalting processes which are known and described in the prior art. Suitable hydrocarbon-selective solvents are light hydrocarbons including ethane, propane, butane, isobutane, pentane, isopentane, neopentane, hexane, isohepane, heptane, mono-olefinic counterparts thereof, etc. The prior art has also taught that aromatic hydrocarbons may be added to enhance the solvent.

The finely divided, unsupported metal catalyst is selected from the group consisting of Groups IVB, VB, VIB, VIIB and VIII and mixtures thereof of the Periodic Table of Elements. The finely divided unsupported metal catalyst may be prepared in any convenient method.

The catalyst or catalyst precursor may be an oil soluble metal compound, a finely divided metal or oil insoluble metal compound which is merely suspended in the hydrocarbon oil.

The finely divided, unsupported metal catalyst is generally present in an amount from about 10 wppm to about 4 weight percent calculated as the elemental metal, based on the weight of coal in the mixture.

Suitable metal compounds convertible to active catalyst under process conditions include inorganic metal compounds such as oxides, hydrated oxides, sulfides, thiosalts, heteropoly acids, isopolyacids, halides, oxyhalides; metal salts of organic acids, metal salts of organic amines; inorganic and organic metal complexes; organometallic compounds.

Various methods can be used to form the finely divided catalyst but a preferred method of forming the finely divided catalyst from the metal compound is to heat the mixture of metal compound, coal and petroleum oil to a temperature ranging from about 600° F. to about 800° F. and at a pressure ranging from about 500 to about 5000 psig in the presence of a hydrogen-containing gas. Preferably, the hydrogen-containing gas also comprises hydrogen sulfide. The hydrogen sulfide may comprise from about 1 to about 90 mole percent and preferably from about 1 to 30 mole percent of the hydrogen containing gas mixture.

The conversion of the metal compound into a finely divided metal catalyst according to the above-described method may be performed in a separate catalyst preparation step or process, or, in situ, in the hydroconversion or reaction zone.

The following example is given to illustrate the process of the present invention and the effectiveness thereof for producing hydrogen-enriched hydrocarbonaceous products from coal and asphaltene containing petroleum oil. It is not intended that the present invention be unduly limited by the example presented.

In this example, the experiments were conducted batch-wise in a rocker autoclave with a capacity of 1800 cc. This example demonstrates the results achieved by the conversion of coal and petroleum oil in the presence of a finely divided unsupported metal catalyst.

A 100 gram sample of finely divided Illinois No. 6 coal having the characteristics presented in Table I was charged to the autoclave together with 200 grams of Boscan topped crude oil having the characteristics presented in Table II and 22.1 grams of molybdenum hexacarbonyl. The autoclave was then pressured with a 10/90 hydrogen sulfide-hydrogen mixture to about 1100 psig and then pressured with pure hydrogen to about 1500 psig. The charged autoclave was then heated to a temperature of about 735° F. and maintained at a pressure of about 2500 psig for one hour. The cooled contents of the autoclave were recovered with a toluene rinse. After the toluene was flashed, the product was solvent separated with isopentane at four volumes of isopentane for each volume of autoclave product. The isopentane soluble fraction was recovered and the isopentane was removed by flashing. The solvent free isopentane soluble product weighed 185.8 grams. The isopentane insoluble fraction which weighed 56.3 grams and contained the finely divided unsupported metal catalyst was recycled with 100 grams of coal and 200.7 grams of Boscan topped crude oil to the autoclave. The hereinabove described heating and pressuring of the autoclave was repeated in an identical fashion. Here again the cooled contents of the autoclave were recovered with a toluene rinse. After the toluene was flashed, the product was solvent separated with isopentane at four volumes of isopentane for each volume of autoclave product. The isopentane soluble fraction was recovered and the isopentane was removed by flashing. The solvent free isopentane soluble product weighed 98.4 grams. The isopentane insoluble fraction which weighed 118.4 grams and contained the finely divided unsupported metal catalyst was recycled with 100 grams of coal and 198.1 grams of Boscan topped crude oil to the autoclave. The corresponding heating, pressuring and subsequent separating as hereinabove described was again repeated in an identical fashion. The solvent free isopentane soluble product weighed 189.7 grams and the isopentane insoluble fraction weighed 178.7 grams. The most recent isopentane insoluble fraction weighing 178.7 grams was charged to the autoclave with 100 grams of coal and 188.1 grams of Boscan reduced crude oil. The hereinabove described autoclave process was again performed to yield an isopentane soluble product weighing 164.1 grams and an isopentane insoluble product weighing 186.7 grams. The resulting isopentane insoluble product was solvent extracted with toluene to yield 130.7 grams of toluene soluble material which is useful for heavy fuel oil and 51.1 grams of toluene insoluble material which contained unconverted coal, mineral matter and catalyst.

The four autoclave runs are summarized in Table III and the toluene extraction of the isopentane insolubles is summarized in Table IV.

TABLE I

| ANALYSIS OF ILLINOIS NO. 6 COAL | |
|---|---|
| Carbon, wt. % | 70.05 |
| Hydrogen, wt. % | 5.88 |
| Oxygen, wt. % | 9.01 |
| Sulfur, wt. % | 2.68 |
| Nitrogen, wt. % | 1.20 |
| Ash, wt. % | 9.02 |
| Moisture (Water), wt. % | 2.15 |

TABLE II

| ANALYSIS OF BOSCAN CRUDE OIL | |
|---|---|
| Gravity, °API at 60° F. | 5.5 |
| Distillation, | |
| IBP, °F. | 693 |
| 5% | 769 |
| 10% | 804 |
| 30% | 977 |
| EP | 977 |
| % OVER (VOLUME) | 30.5 |

TABLE II-continued

| ANALYSIS OF BOSCAN CRUDE OIL | |
|---|---|
| Carbon, wt. % | 82.8 |
| Hydrogen, wt. % | 10.6 |
| Nitrogen, wt. % | 0.8 |
| Sulfur, wt. % | 5.6 |
| Heptane Insolubles, wt. % | 19.04 |
| Vanadium, ppm | 1500 |
| Nickel, ppm | 130 |

TABLE III

SUMMARY OF BATCH RECYCLE AUTOCLAVE RUNS

| Run No. / Charge | 1 | 2 | 3 | 4 |
|---|---|---|---|---|
| Coal, g | 100 | 100 | 100 | 100 |
| Topped Boscan Oil, g | 200 | 200.7 | 198.1 | 188.1 |
| Mo(CO)6, g | 22.1 | — | — | — |
| Recycle, g | — | 56.3 | 117.3 | 177.9 |
| Product Recovery | | | | |
| Toluene Free, g | 261.1 | 221.5 | 381.1 | 422.0 |
| Isopentane Soluble, g | 185.8 | 98.4 | 189.7 | 164.1 |
| Carbon, wt. % | 86.22 | | 84.03 | |
| Hydrogen, wt. % | 11.44 | | 10.78 | |
| Oxygen, wt. % | 0.17 | | 0.10 | |
| Sulfur, wt. % | 2.77 | | 3.17 | |
| Nitrogen, wt. % | 0.43 | | 0.56 | |
| Nickel, ppm | 2.7 | | 1.8 | |
| Vanadium, ppm | <1 | | 18 | |
| Heptane Insoluble, wt. % | <0.01 | | 0.3 | |
| Isopentane Insoluble, g | 56.3 | 118.4 | 178.7 | 186.7 |

TABLE IV

TOLUENE EXTRACTION OF THE ISOPENTANE INSOLUBLES

| Charge, g | 186.7 | |
|---|---|---|
| | Toluene Soluble | Toluene Insoluble |
| Recovered Weight, g | 130.7 | 51.1 |
| Carbon, wt. % | 84.74 | 31.60 |
| Hydrogen, wt. % | 7.66 | 3.04 |
| Oxygen, wt. % | 2.73 | — |
| Sulfur, wt. % | 2.36 | 14.1 |
| Nitrogen, wt. % | 1.43 | — |
| Molybdenum, wt. % | | 6.70 |
| Vanadium, wt. % | | 1.73 |
| Nickel, wt. % | | 0.15 |
| Iron, wt. % | | 6.8 |

From the foregoing description and example, it is apparent that the process of the present invention provides a superior method for producing hydrogen-enriched hydrocarbonaceous products from coal and asphaltene containing petroleum oil.

I claim:

1. A process for the production of hydrogen-enriched hydrocarbonaceous products from hydrocarbonaceous materials which comprises:

(a) commingling coal and a crude petroleum oil containing asphaltenes and heavy oils in amount such that at least 80% of the crude boils above 650° F.;

(b) subjecting the resultant mixture to conversion together with a hereinafter described liquid recycle stream containing finely divided, unsupported metal catalyst in which the metal is selected from the group consisting of the elements from Groups IVB, VB, VIB, VIIB and VIII of the Periodic Table of Elements and mixtures thereof in a reaction zone at a temperature from about 55° F. to about 950° F. and a hydrogen pressure from about 500 psig to about 10,000 psig to liquefy at least a portion of said coal and to reduce the asphaltene content of said oil;

(c) separating gas from the resultant reaction zone effluent;

(d) then solvent deashing at least a portion of the reaction zone effluent with a relatively low molecular weight hydrocarbon solvent to separate therefrom a heavy liquid phase containing substantially all of the ash, unconverted coal, asphaltenes, relatively high molecular weight hydrocarbons and finely divided, unsupported metal catalyst; and (e) supplying at least a portion of said heavy liquid phase to the reaction for use as said liquid recycle stream in the aforesaid step (b).

2. The process of claim 1 wherein said asphaltene containing petroleum oil has a 50% boiling point greater than about 1000° F.

3. The process of claim 1 wherein said finely divided unsupported metal catalyst comprises molybdenum.

4. The process of claim 1 wherein said finely divided unsupported metal catalyst comprises vanadium.

5. The process of claim 1 wherein the weight ratio of asphaltene containing petroleum oil to coal is from about 1:1 to about 5:1.

6. The process of claim 1 wherein the liquid flow rate in said reaction zone results in a liquid hourly space velocity of about 0.5 to about 10.

7. The process of claim 1 wherein the hydrogen circulation rate in said reaction zone is from about 5,000 to about 20,000 SCFB based on the reaction zone charge.

* * * * *